US009089170B2

(12) United States Patent
Muratore, II

(10) Patent No.: US 9,089,170 B2
(45) Date of Patent: Jul. 28, 2015

(54) PRE-FORMED POCKET SQUARE MEMBER WITH SECURING MEMBER

(71) Applicant: Peter F. Muratore, II, Mendham, NJ (US)

(72) Inventor: Peter F. Muratore, II, Mendham, NJ (US)

( * ) Notice: Subject to any disclaimer, the term of this patent is extended or adjusted under 35 U.S.C. 154(b) by 84 days.

(21) Appl. No.: 13/998,781

(22) Filed: Dec. 5, 2013

(65) Prior Publication Data

US 2015/0157059 A1 Jun. 11, 2015

(51) Int. Cl.
*A41B 15/02* (2006.01)
*A41B 15/00* (2006.01)

(52) U.S. Cl.
CPC ..... *A41B 15/02* (2013.01)

(58) Field of Classification Search
CPC ..... A41B 15/02; A41B 15/00; A45F 5/04; A45F 5/022; A41D 27/20
See application file for complete search history.

(56) References Cited

U.S. PATENT DOCUMENTS

| | | | | | |
|---|---|---|---|---|---|
| 1,631,398 | A | * | 6/1927 | Campbell | 2/279 |
| 2,022,793 | A | * | 12/1935 | Trickel | 2/279 |
| 2,060,729 | A | * | 11/1936 | Gilgenbach | 2/279 |
| 2,079,139 | A | * | 5/1937 | Woof | 2/279 |
| 2,163,710 | A | * | 6/1939 | Schockling | 24/3.5 |
| 2,211,023 | A | * | 8/1940 | Murphy | 24/3.5 |
| 2,269,511 | A | * | 1/1942 | Biederman | 2/279 |
| 2,379,092 | A | * | 6/1945 | Robert | 24/3.5 |
| 2,495,012 | A | * | 1/1950 | Kugler | 24/3.1 |
| 2,513,154 | A | * | 6/1950 | Dundon | 2/279 |
| 2,551,184 | A | * | 5/1951 | Valenti | 2/279 |
| 2,597,146 | A | * | 5/1952 | Ginal, Jr. | 2/279 |
| 2,722,013 | A | * | 11/1955 | Fisher | 2/279 |
| 2,738,515 | A | * | 3/1956 | Owen | 2/279 |
| 2,777,133 | A | * | 1/1957 | Phillips, Jr. | 2/279 |
| 2,778,080 | A | * | 1/1957 | Kernicki | 24/3.5 |
| 2,815,509 | A | * | 12/1957 | Williamson | 2/279 |
| 2,964,811 | A | * | 12/1960 | Loehnert | 24/3.12 |
| 2,968,045 | A | * | 1/1961 | Johnson | 2/279 |
| 3,072,917 | A | * | 1/1963 | Watson, Jr. | 2/279 |
| 3,135,030 | A | * | 6/1964 | Weber | 24/3.5 |
| 3,135,967 | A | * | 6/1964 | Stephens | 2/279 |
| 3,184,759 | A | * | 5/1965 | Masters | 2/279 |
| 3,196,461 | A | * | 7/1965 | Erhardt | 2/279 |

(Continued)

FOREIGN PATENT DOCUMENTS

| | | |
|---|---|---|
| JP | 2001011703 | 1/2001 |
| JP | 2008061979 | 3/2008 |

*Primary Examiner* — Bobby Muromoto, Jr.
(74) *Attorney, Agent, or Firm* — Ernest D. Buff & Assoc, LLC; Ernest D. Buff; Margaret A. LaCroix, Esq.

(57) ABSTRACT

A pre-folded pocket square with securing member has a pre-folded pocket square member and a pre-formed pocket square holder or securing member that cooperate to securely hold the pre-folded pocket square within a breast pocket. The pre-folded pocket square member has a main body portion and a top portion. At least a segment of the top portion is appointed to protrude from the pocket. Preferably, the pre-folded pocket square member has a main body portion with a cavity that is adapted to receive the securing member. In another embodiment, the securing member and pre-folded pocket square member include mating attachment means. In still another embodiment, the securing member includes a spring loaded member for securing the pre-folded pocket square member within the pocket. The pre-folded pocket square with securing member retains its folded shape and appearance throughout wear of the clothing apparel.

24 Claims, 13 Drawing Sheets

(56) References Cited

U.S. PATENT DOCUMENTS

| | | | | | |
|---|---|---|---|---|---|
| 3,216,135 | A | * | 11/1965 | Wright | 40/1.5 |
| 3,371,829 | A | * | 3/1968 | Phillips | 224/230 |
| 3,412,435 | A | * | 11/1968 | Poppe | 24/3.7 |
| 3,492,677 | A | * | 2/1970 | Bertelink | 2/279 |
| 3,512,182 | A | * | 5/1970 | Bezanilla | 2/279 |
| 3,514,790 | A | * | 6/1970 | Harvey | 2/279 |
| 3,618,142 | A | * | 11/1971 | Bruni | 2/239 |
| 3,786,520 | A | * | 1/1974 | Harmon | 2/279 |
| 4,083,446 | A | * | 4/1978 | Schuchman, Sr. | 206/38 |
| 4,417,370 | A | * | 11/1983 | Lewis | 24/3.11 |
| 4,897,900 | A | * | 2/1990 | Baggett | 24/543 |
| D307,516 | S | * | 5/1990 | Lesch | D3/226 |
| D308,763 | S | * | 6/1990 | Lesch | D3/226 |
| D308,764 | S | * | 6/1990 | Lesch | D3/226 |
| D309,061 | S | * | 7/1990 | Lesch | D3/226 |
| 5,231,702 | A | * | 8/1993 | Masters | 2/244 |
| 5,253,370 | A | * | 10/1993 | Mead | 2/279 |
| D384,485 | S | * | 10/1997 | Kwak | D2/502 |
| D459,054 | S | * | 6/2002 | Kwak | D2/500 |
| 6,412,118 | B1 | * | 7/2002 | Shanklin | 2/279 |
| 7,107,627 | B2 | * | 9/2006 | Holland | 2/247 |
| 7,168,137 | B1 | * | 1/2007 | Oustian et al. | 24/7 |
| D600,427 | S | * | 9/2009 | Hernandez | D2/501 |
| D600,890 | S | * | 9/2009 | Groves | D2/860 |
| D659,999 | S | * | 5/2012 | Curry, Jr. | D3/303 |
| D669,657 | S | * | 10/2012 | Lee | D2/500 |
| 8,347,417 | B1 | * | 1/2013 | Chur | 2/279 |
| D676,218 | S | * | 2/2013 | Lee | D2/500 |
| D689,667 | S | * | 9/2013 | Lee | D2/500 |
| D693,088 | S | * | 11/2013 | Lee | D2/500 |
| D707,016 | S | * | 6/2014 | Lee | D2/500 |
| D712,624 | S | * | 9/2014 | Lee | D2/500 |
| 2005/0144705 | A1 | * | 7/2005 | Holland | 2/279 |
| 2007/0000024 | A1 | | 1/2007 | Kozul | 2/171 |
| 2007/0113323 | A1 | * | 5/2007 | Groves | 2/279 |
| 2008/0184460 | A1 | * | 8/2008 | Jones | 2/279 |
| 2009/0260395 | A1 | * | 10/2009 | Coleman | 63/20 |
| 2014/0090151 | A1 | * | 4/2014 | McClellan | 2/244 |
| 2014/0352034 | A1 | * | 12/2014 | Bhiro | 2/279 |
| 2015/0096110 | A1 | * | 4/2015 | Guvenc | 2/279 |

* cited by examiner

PRE-FORMED POCKET SQUARE MEMBER WITH SECURING MEMBER

BACKGROUND OF THE INVENTION

1. Field of the Invention

The present invention relates to pocket squares/handkerchiefs; and, more particularly, to pocket squares/handkerchiefs with securing member or holding apparatus, systems and methods for use within a pocket of a suit jacket, vest, dress or other clothing apparel to create a stylish or formal appearance.

2. Description of the Prior Art

To create a professional polished image, pocket handkerchiefs or pocket squares are oftentimes positioned in breast-pockets of suit jackets, vests, dresses, or other clothing apparel. A handkerchief, also called a handkerchief or hanky, is a form of a kerchief. Typically having the form of a hemmed square of thin fabric, a handkerchief can be carried in the pocket. Once intended for personal hygiene purposes, kerchiefs are these days more commonly used as a purely decorative accessory in a suit pocket. When used as an accessory to a suit, a handkerchief is sometimes referred to as a pocket square.

Proper placement of pocket squares can be difficult. Proper folding techniques must be utilized to maintain the pocket square in a neat, folded condition that presents a pleasant, "button downed" appearance. In addition, the pocket square must be held in place throughout wearing of the associated jacket or clothing apparel. Typically one must wash, iron, and fold a pocket square, and then arrange it in place without creating a large bulge in the pocket of a sport coat, for example. This can be difficult and time consuming, and often leads to frustration the wearer. Even still, as the day wanes the folded pocket square oftentimes fails to maintain its folded condition, producing instead a disheveled appearance.

Pocket squares and/or handkerchiefs may come pre-folded or pre formed to a given shape or design, or may come as a generally square or rectangular cloth member that is to be folded as desired. Different folds for pocket squares/handkerchiefs are considered typical when styling the pocket square.

Various pocket squares/handkerchiefs and securing or holding devices have heretofore been disclosed and utilized. Several of the pocket square and securing devices involve cardboard, fiber or plastic inserts that retain a portion of a pocket square, so that when the insert is placed in the pocket a portion of the pocket square remains outside for viewing. Other devices involve envelopes wherein the pocket square is received, and wherein the envelope with pocket square is then placed in yet another vessel and/or placed in a pocket. Still other devices involve rigid supports that are folded or configured to fit within the pocket of apparel. Examples of heretofore disclosed and utilized devices are summarily set forth below:

U.S. Pat. No. 1,631,398 to Campbell discloses a display kerchief adapted to be secured in place by a cardboard member having a loop that supports a bottom corner/portion of the display kerchief. U.S. Pat. No. 2,060,729 to Leo discloses a pocket handkerchief simulation that comprises a casement, a pair of tabs simulating handkerchief corners united to effect a pocket, and a stiffener within the casing and extended into the pocket. The handkerchief is folded and a stiffener is slid within the handkerchief, which in turn is then inserted into an envelope. U.S. Pat. No. 2,269,511 to Biederman discloses a preformed show-kerchief adapted to engage into the breast pocket that includes a rigid support that engages into the bottom of the pocket and supports the preformed kerchief at a suitable elevation, so that the pointed portions thereof project from the pocket. U.S. Pat. No. 2,597,146 to Ginal Jr. and U.S. Pat. No. 3,514,790 to Harvey disclose simulated handkerchief configurations. U.S. Pat. No. 2,964,811 to Loehnert discloses a handkerchief holder. U.S. Pat. No. 3,786,520 to Harmon discloses a combination decorative pocket ornament and adjustable holder that includes gripping fingers and a slidable clamping bar and an adapter member for raising or lowering the same within the pocket so that the device can be used for a variety of different pocket sizes. U.S. Pat. No. 4,417,370 to Lewis discloses a pocket handkerchief clip that is spring-biased to receive a folded handkerchief or a shaped handkerchief accessory. U.S. Pat. No. 4,897,900 to Baggett discloses a holder for a pocket square that includes two panels joined together by a living hinge for receiving a pocket square between them. U.S. Pat. No. 5,253,370 to Mead discloses a dual purpose adjustable base for mounting pre-folded "pocket silk" handkerchiefs formed as a unibody base joining two sections of leatherette, wherein the stitching is left open at the top to accommodate a three dimensional, simulated pocket silk handkerchief U.S. Pat. No. 6,412,118 to Shanklin discloses a pocket handkerchief woven entirely of fabric and stitched such that an ornamental part of the handkerchief is visible when deposited in the pocket. U.S. Pat. No. 7,107,627 to Holland discloses a handkerchief valet that continually maintains the handkerchief in the same shape and height in the upper exterior left side chest pocket of a suit coat or sports coat or jacket as originally positioned. U.S. Design Pat. No. D600890 to Groves discloses an ornamental design for a pocket square holder. U.S. Design Pat. No. 8,347,417 to Chur discloses an adjustable handkerchief holder ornamental design including an envelope that receives a handkerchief housed in a second envelope. U.S. Design Pat. No. D600427 to Hernandez discloses an ornamental design for an adjustable handkerchief holder; generally the design includes an envelope that receives a handkerchief housed in a second envelope appointed to then be placed within a jacket pocket. U.S. Patent App. Pub. No. 20070000024 to Kozul discloses a kerchief member for wearing about the head. U.S. Patent Application Publication No. 20070113323 to Groves discloses a pocket square holding apparatus provided with a housing, a support member for securing and stabilizing the pocket square on the housing, and an extension or bale member selectively movable between a retracted position and an extended position so that the overall length of the housing can be adjusted. U.S. Patent Application Publication No. 20080184460 to Jones discloses a pocket square/handkerchief holder including a generally curved elongated holding member, a clasp member, and a clipping device. U.S. Patent Application Publication No. 20090260395 to Coleman discloses a pocket square brooch containing an overlapped display of triangular leafs fashioned to replicate the image of an artistically folded cloth handkerchief. Foreign Patent Publication No. JP2008061979 to Konuma et al. discloses a holder capable of carrying a handkerchief constructed generally as a tube at a suspender for hooking the handkerchief. Foreign Patent Publication No. JP2001011703 to Yamaguchi discloses a baggy bag handkerchief housing an article such as a cellular phone. Non-Patent Literature entitled "Pockerchief-.Com A Pre-Folded Designer Handkerchief . . . " found at http://www.pockerchief.com/ and non-Patent Literature entitled "Custom Folded Pocket Squares" found at http://pocketsquarez.com/ disclose pre-folded designer handkerchiefs mounted on a full size card insert.

Despite the aforementioned pocket square and securing member/holder assemblies, there remains a need in the art for improved assemblies. Many assemblies are constructed so that the pocket square is permanently mounted on the insert/holder device. As a result, the pocket square cannot be readily washed and laundered without destroying the integrity of the insert/holder device. Other assemblies require multiple steps in compiling the assembly, and as a result, it takes the user longer to prepare the assembly in the pocket. This, in turn, increases the risk that the assembly will be incorrect or result in a disheveled appearance. Still others result in a holder device that is too rigid. With such a rigid construction, the assembly looks to be inflexible and stiff, projecting an unnatural appearance at the breast pocket and chest of the wearer. Moreover, because pocket sizes vary permanently mounted or preformed don't provide proper fit within varying sized pockets.

There remains a need in the art for a pocket square that is readily placed within a pocket with minimal manipulation by a user, and that maintains its folded shape and appearance throughout the day/evening when the suit jacket/apparel is being worn. Further, there exists a need in the art for a holder apparatus that can be utilized in a variety of pocket sizes to perfectly square-up the pre-sewn pocket square in a suit, vest or jacket pocket so as to obviate many of the steps currently required to maintain proper placement of pocket squares.

SUMMARY OF THE INVENTION

The present invention provides a pocket square that is readily placed within a pocket with minimal manipulation by a user, and that maintains its folded shape and appearance throughout the day/evening when the suit jacket/apparel is being worn. The pocket square is constructed as a pre-sewn/pre-folded pocket square that is especially well suited for association with a pocket square holder/securing member apparatus that perfectly squares-up the pre-sewn pocket square in a suit, vest or jacket pocket so as to obviate many of the steps currently required to maintain proper placement of the pocket square. Perfect squaring-up is achieved by way of a pre-folded pocket square body that is mounted in association with a holder apparatus received within the pocket of the suit jacket. As used herein, the term "clothing apparel" means a suit jacket; however it will be understood by those skilled in the art that the pocket square is well suited for use with any type of clothing apparel wherein a breast located pocket receives a handkerchief.

In a most preferred embodiment, at least one strip or magnetic insert member is provided that is adapted to be placed on the interior of the breast pocket of the clothing apparel for magnetic attachment to the securing member. Either or both of the strip and/or securing member are composed of a magnetic strip and metal/or magnetic strips for magnetic mating. In operation, the strip is adapted to be placed on an inside wall/interior of the clothing apparel in alignment with the securing member located within the pre-folded pocket square member within the pocket of the clothing apparel and the strip or magnetic insert further facilitates holding the pocket square in place in the pocket.

In a first preferred embodiment there is provided a pre-folded pocket square member with securing member for use within a pocket of clothing apparel, comprising: (a) a pre-folded pocket square member having a main body portion with a cavity therein and an opening thereto and a top portion, wherein the body portion is appointed to be placed and received within the pocket of the clothing apparel while at least a portion of the top portion is appointed to protrude from the pocket; (b) a securing member adapted to be received within the cavity of the pre-folded pocket square member, for forcing the pre-folded pocket square member to remain upright, secured and aligned within the pocket; (c) the securing member comprising a main body that conforms in size and structure to the cavity, wherein at least a portion of the main body tightly fits within the cavity of the main body portion of the pre-folded pocket square member, and the securing member securely holds the pre-folded pocket square member in an upright position within the pocket without need for additional clips or securement.

In another preferred embodiment, a pre-folded pocket square member having a securing member for use within a pocket of clothing apparel, comprises: (a) a pre-folded pocket square member, having a main body portion and a top portion wherein the body portion is appointed to be placed and received within the pocket of the clothing apparel while at least a portion of the top portion is appointed to protrude from the pocket; (b) the pre-folded pocket square member having pocket attachment means; and (c) a securing member comprising mating attachment means appointed to mate with the pocket attachment means of the pre-folded pocket square member. The mating attachment means are associated with the pocket of the clothing apparel, and adapted to mate with the pocket attachment means of the pre-formed pocket square holder to securely hold the pre-folded pocket square member within the pocket.

Still another preferred embodiment provides a pre-folded pocket square member with a securing member for use within a pocket of clothing apparel, comprising: (a) a pre-folded pocket square member having a main body portion and a top portion wherein the body portion is appointed to be placed and received within the pocket of the clothing apparel while at least a portion of the top portion is appointed to protrude from the pocket; (b) a securing member adapted to be received within the pocket of the clothing apparel and being associated with the pre-folded pocket square member to force the pre-folded pocket square member to remain upright, secured and aligned within the pocket; and (c) the securing member comprising a spring loaded holder mechanism having edges, the pocket of the clothing apparel having side walls and a bottom wall, the edges of the holder operating to press against side walls of the pocket.

BRIEF DESCRIPTION OF DRAWINGS

The invention will be more fully understood and further advantages will become apparent when reference is had to the following detailed description and the accompanying drawings, in which.

DESCRIPTION OF THE PREFERRED EMBODIMENTS

Figure 1:
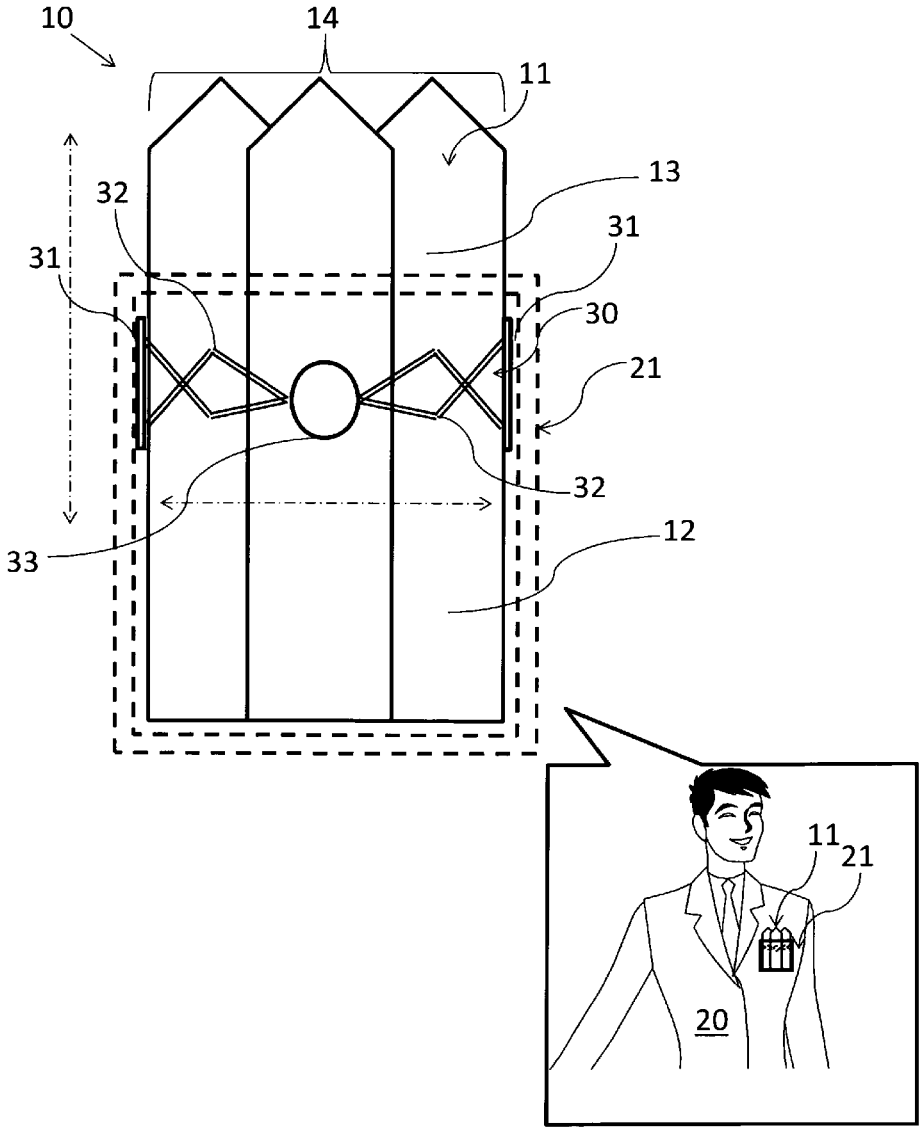
FIG. 1 illustrates a first embodiment of the subject pre-formed pocket square member with securing member.

The present invention provides a pre-sewn/pre-formed pocket square and securing member apparatus that perfectly squares-up a pre-sewn pocket square in a suit, vest or jacket pocket, thereby obviating many of the steps currently required to maintain proper placement of pocket squares. Perfect squaring-up is achieved by way of a pre-folded pocket square body that is mounted in association with a securing member apparatus received within the pocket of the suit jacket or clothing apparel. Generally stated, the pre-folded pocket square with securing member apparatus is constructed to include a pre-folded pocket square member and a pre-formed pocket square holder or securing member that cooperate to securely retain the pre-folded pocket square within a breast pocket. The pre-folded pocket square member is generally constructed having a main body portion and a top portion. At least a segment of the top portion is appointed to protrude from the pocket, while at least a segment of the body portion is appointed to be placed and received within the pocket of the article of clothing. The pre-formed pocket square holder or securing member is adapted to secure the pre-folded/pre-formed pocket square member to force the pre-folded pocket square member to remain upright, secured and aligned within the pocket.

The subject pre-formed pocket square with securing member broadly comprises: (i) a pre-folded pocket square member, having a main body portion and a top portion wherein the body portion is appointed to be placed and received within a pocket of an article of clothing while at least a portion of the top portion is appointed to protrude from the pocket; (ii) a pre-formed pocket square holder or securing member that is adapted to be received within the pocket of the suit jacket and associates with the pre-folded pocket square member to force the pre-folded pocket square member to remain upright, secured and aligned within the pocket.

The pre-folded pocket square member is formed in a plethora of shapes as is generally preformed in a variety of pocket square folding configurations. These configurations of the pre-folded pocket square may include, for non-limiting example: (1) "The Presidential", wherein the pocket square is pre-folded at right angles; (2) "The TV Fold", wherein the pocket square is pre-folded diagonally; (3) "The One-point Fold", wherein the pocket square is pre-folded diagonally with the point protruding from the pocket; (4) "The Two-point Fold", wherein the pocket square is pre-folded off-center so the two points do not completely overlap; (5) "The Three-point Fold", wherein the pocket square is first folded into a triangle, then the corners are folded up and across to make a pre-folded configuration having three points; and (6) "The Four-point Fold", wherein the pocket square is pre-folded via an off-center version of the Three-point Fold. While the pre-folded pocket square may be prefabricated or configured in any of these pre-formed configurations, other configurations are anticipated and any pre-folded configuration can be utilized without departing from the scope of the subject invention. In so pre-forming the pocket square, the body portion is preferable formed generally as a parallelogram, rectangle, triangle, etc., depending on the fold configuration style of the handkerchief/pocket square. The top portion includes a decorative folded configuration.

FIG. 1 illustrates a first embodiment of the pre-formed pocket square with securing member shown generally at 10. The pre-formed pocket square with securing member is appointed to be placed within a pocket 21 of a suit jacket 20 lapel (or any clothing having a lapel pocket appointed to receive a pocket square therein). Herein clothing apparel is specified as a suit jacket 20; however any type of clothing apparel having a breast/lapel pocket for receiving a pocket square is contemplated for use in accordance with the invention.

A pre-folded pocket square member 11 is provided. Pre-folded pocket square member 11 generally comprises a main body portion 12 and a top portion 13. Body portion 12 is appointed to be placed and received within pocket 21 of suit jacket 20 while at least a portion of top portion 13 is appointed to protrude from pocket 21 and be visible for aesthetic appeal. Body portion 12 is preferable formed generally as a parallelogram, rectangle, triangle, or the like, depending on the fold configuration style of the handkerchief/pocket square. Top portion 13 includes a decorative folded configuration generally shown as 14, and commonly known as a "three-point fold". Herein the decorative folded configuration 14 is shown. However, it will be understood that there are a wide variety of ways to fold a pocket square/handkerchief; accordingly, the pre-fold configuration can be arranged in an array of different formations. Some fold types or formations of the pre-folded pocket square member 11 may include, for non-limiting examples: 1) "The Presidential", wherein the pocket square is pre-folded at right angles; 2) "The TV Fold", wherein the pocket square is pre-folded diagonally and the point represents the body portion 12 adapted to go inside the pocket 21; 3) "The One-point Fold", wherein the pocket square is pre-folded diagonally with the point showing representing the top portion 13 protruding from the pocket; 4) "The Two-point Fold", wherein the pocket square is pre-folded off-center so the two points do not completely overlap; 5) "The Three-point Fold", wherein the pocket square is first folded into a triangle, then the corners are folded up and across to make a pre-folded configuration having three points as is shown in FIG. 1 via folded edge 14; and 6) "The Four-point Fold", wherein the pocket square is per-folded via an off-center version of the Three-point Fold. While the pre-folded pocket square may be prefabricated or configured in any of these pre-formed configurations, other configurations are anticipated and any pre-folded configuration can be utilized without departing from the scope of the present invention.

The pre-formed pocket square with securing member further comprises a pre-formed pocket square securing member 30 that is adapted to be received within the pocket 21 of the suit jacket 20. In the embodiment shown in FIG. 1, securing member 30 comprises a spring loaded securing member mechanism having edges 31 with pivoting rods 32 attached to a spring hub 33 so that the pivoting rods 32 and visa vie edges 31 expand and contract based on pressure/force on edges 31. Edges 31 preferably include pressure clamps for removable securement of the pre-folded/pre-formed pocket square 11 to edges 31 to cause the pre-folded/preformed pocket square member 11 to remain ridged and upright when the pocket square member 11 and securing member 30 is placed within the pocket. Optionally, the securing member 30 may be integrated within the pocket 21 of jacket 20. Securing member 30 applies pressure or force on the inner edges of the pocket 21 so that the pre-sewn pocket square member 11 maintains its positioning in the pocket 21.

Figure 2A:
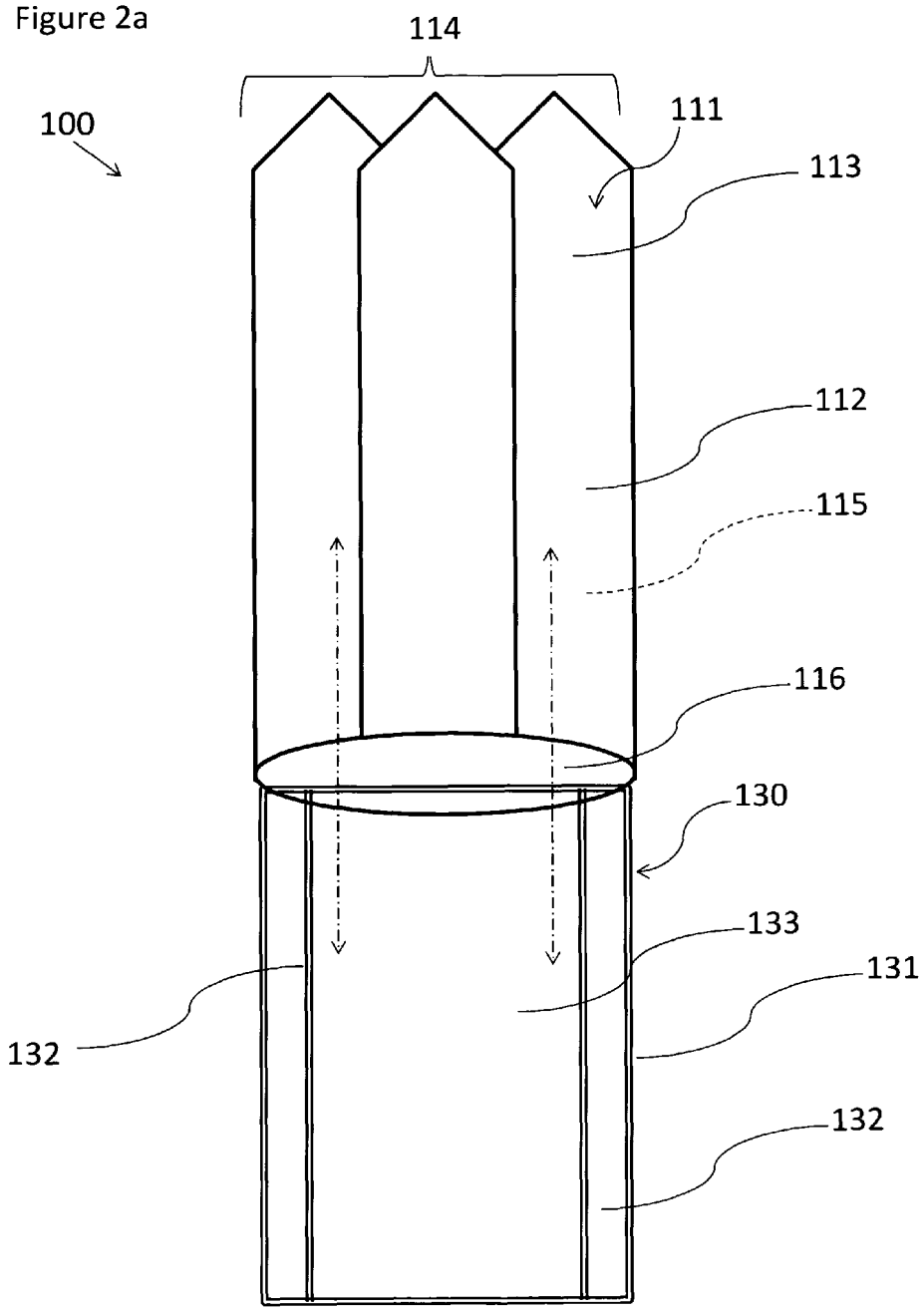
FIG. 2*a* illustrates another embodiment of the subject pre-formed pocket square member with securing member showing a pre-formed securing member device being inserted within a pre-formed pocket square.
Figure 2B:
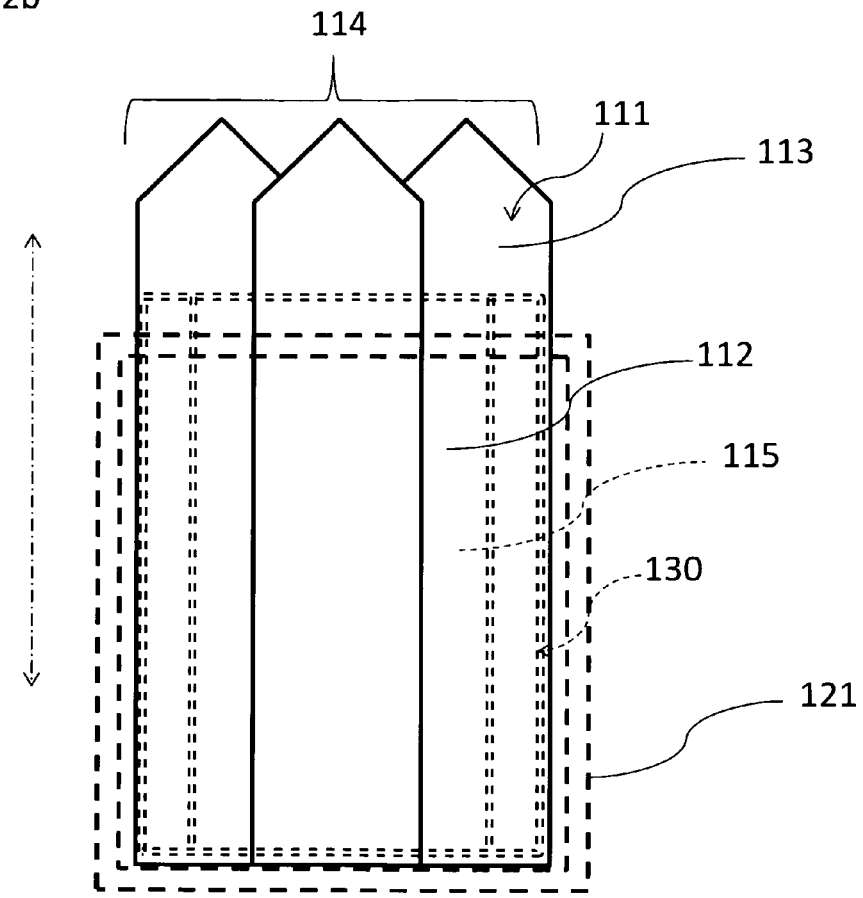
FIG. 2*b* illustrates the embodiment of FIG. 2*a* wherein the pre-formed pocket square and securing member is inserted within a pocket.
Figure 2C:
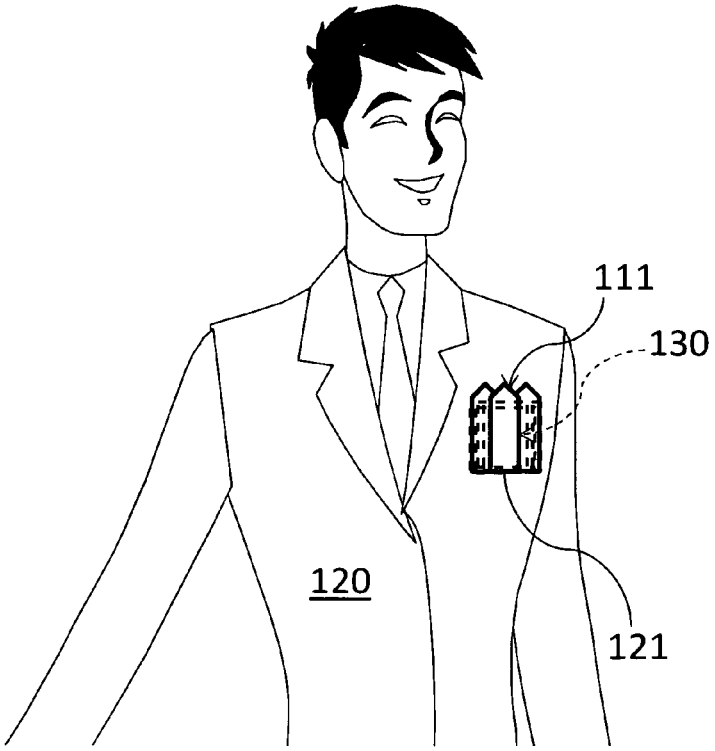
FIG. 2*c* illustrates the embodiment of FIG. 2*a* wherein the pre-formed pocket square and securing member is inserted within a breast jacket pocket/within the pocket of clothing apparel.

FIGS. 2*a*-2*c* illustrates views of a second embodiment of the pre-formed pocket square with securing member shown generally at 100. The pre-formed pocket square with securing member 100 is appointed to be placed within a pocket 121 of a suit jacket 120. A pre-folded pocket square member 111 is provided having a main body portion 112 and a top portion 113 having a decorative folded edge 114 as discussed hereinabove. However, in this embodiment, pre-folded pocket square member 111 is formed having a cavity 115 within a body portion 112 having an opening 116. In turn, cavity 115 of body portion 112 is adapted to receive therein through opening 116 a pre-formed pocket square securing member 130 that is formed generally as a wire frame or other stiffened structure. Securing member 130 traverses through opening 116 and is snuggly received within cavity 115 of pre-folded pocket square member 111 and securing member 130 imparts rigidity to pre-folded pocket square member 111. Pre-folded pocket square member 111 with securing member 130 housed therein is preferably removably housed therein so that the square member 111 can be interchanged to other fold designs and/or washed. After being washed, the pre-folded pocket square member 111 is placed within pocket 121 of jacket 120. In this manner, pre-folded pocket square member 111 with securing member 130 housed therein maintains a perfect upright position within pocket 121 of jacket 120 throughout wear.

In the embodiment shown in FIGS. 2*a*-2*c* securing member 130 is shown with its main body formed as a wire frame constructed from frame members and at least one open area. Preferably, the main body of the securing member 130 is formed as a wire frame 131 having two parallel side wall frame members 132 surrounding a substantially centrally located open area 133. In this manner, while the securing member 130 holds the pre-formed pocket square member in place it imparts a non-rigid view to others as the material of the pocket and suit jacket covering over the open area 133 are free from contact from the otherwise rigid wire frame 131. As a result, the material is more natural and there is no appearance of rigidity at the breast pocket to others.

FIGS. 3*a*-3*e* illustrates alternative embodiments of the subject securing member 130 of FIG. 2*a*.

Figure 3A:
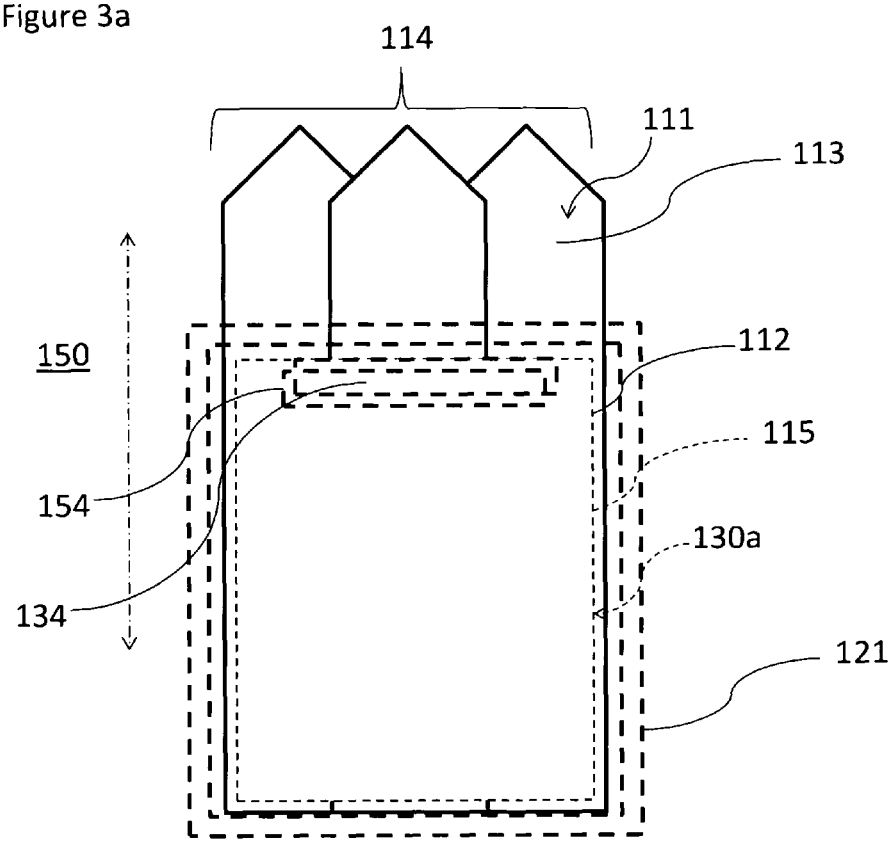
FIGS. 3*a*-3*e* illustrates alternative embodiments of the subject securing member of FIG. 2*a;*

FIG. 3*a* shows a securing member 130*a* constructed having a main body formed as a substantially solid construct without open areas. In this embodiment, preferably at least a portion of the solid construct is composed of a flexible material so as to impart a degree of flexibility to the securing member 130*a*. Preferably, the flexible material region is located substantially central to the main body so that the pocket of the wearer does not appear rigid to others. A mating magnet strip 134 integrated within the securing member 130*a*, which may be a strip or alternatively, securing member 130*a* may simply include a metal segment capable of mating with a magnet. Mating magnetic strip 134 (or securing member 130*a*) is adapted to mate with a magnetic insert member 154 to be placed on the interior of the breast pocket of the clothing apparel 150 for magnetic attachment to the mating magnet strip 134*b* of the securing member 130*b*. Either or both of the strip and/or securing member are composed of a magnetic strip and metal/or magnetic strips for magnetic mating. In operation, the strip is adapted to be placed on an inside wall/interior of the clothing apparel in alignment with the securing member located within the pre-folded pocket square member within the pocket of the clothing apparel and the strip or magnetic insert further facilitates holding the pocket square in place in the pocket.

Figure 3B:
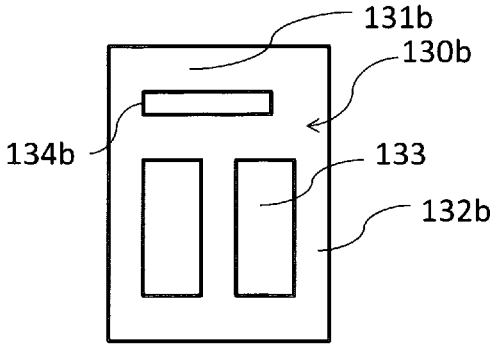

FIG. 3*b* shows a securing member 130*b* having a main body formed with an upper segment 131*b* fixedly attached to a lower segment 132*b*. The lower segment 132*b* includes at least two open space areas 133. An optional attachment means 134*b* is preferably provided within the upper segment 132*b*. The attachment means 134*b* is preferably a magnetic strip adapted to receive a mating magnet strip for further securing the pre-folded pocket square onto the securing member.

In this arrangement, a mating magnet strip 134*b* is adapted to mate with a magnetic insert member 154 (see Fig. a) to be placed on the interior of the breast pocket of the clothing apparel 150 for magnetic attachment to the mating magnet strip 134*b* of the securing member 130*b*. Either or both of the strip and/or securing member are composed of a magnetic strip and metal/or magnetic strips for magnetic mating. In operation, the strip is adapted to be placed on an inside wall/interior of the clothing apparel in alignment with the securing member located within the pre-folded pocket square member within the pocket of the clothing apparel and the strip or magnetic insert further facilitates holding the pocket square in place in the pocket.

Figure 3C:
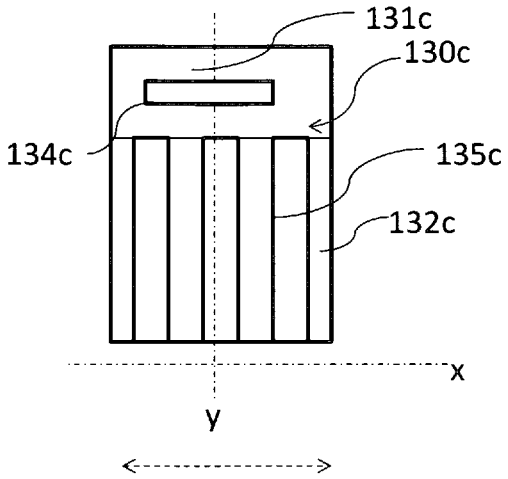

FIG. 3*c* shows a securing member 130*c* having a main body formed with an upper segment 131*c* fixedly attached to a lower segment 132*c*. The lower segment 132*c* is preferably composed of a flexible material, such as a rubber, silicon, fiber, flexible polymeric material, cardboard, or paper material, forming at least one fold 135*c* for expansion and contraction to impart a degree of flexibility to the lower segment 132*c* of the main body of the securing member. In FIG. 3*c* the lower segment 132*c* is composed of a plurality of folds 135*c* arranged vertically and parallel to one another on a vertical plane y for expansion and contraction on a horizontal plane x to impart a degree of flexibility to the lower segment of the main body of the securing member. Folds 135*c* act as accordion portions so that the folds can open and close over one another for expansion and contraction. An optional attachment means 134*c* may be provided preferably within the upper segment 132*c*. The attachment means 134*c* is preferably a magnetic strip adapted to receive a mating magnet strip for further securing the pre-folded pocket square onto the securing member. Mating magnet strip 134*c* is adapted to mate with a magnetic insert member 154 (see Fig. a) to be placed on the interior of the breast pocket of the clothing apparel 150 for magnetic attachment to the mating magnet strip 134*c* of the securing member 130*c*.

Figure 3D:
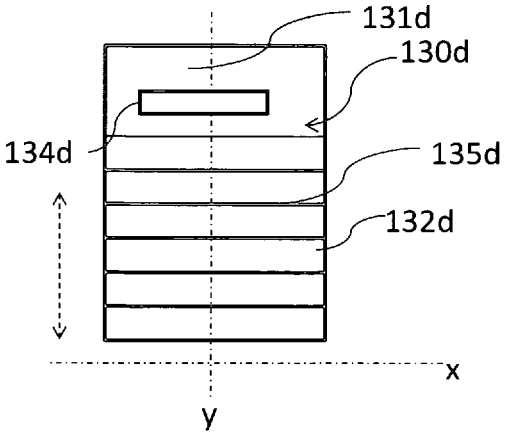

FIG. 3*d* shows an embodiment of a securing member 130*d* wherein a lower segment 132*d* is composed of a plurality of folds 135*d* arranged horizontally and parallel to one another on a horizontal plane x for expansion and contraction on a vertical plane y to impart a degree of flexibility to the lower segment of the main body of the securing member. An optional attachment means 134*d* may be provided preferably within the upper segment 132*d*. The attachment means 134*d* is preferably a magnetic strip adapted to receive a mating magnet strip for further securing the pre-folded pocket square onto the securing member. Mating magnet strip 134*d* is adapted to mate with a magnetic insert member 154 (see Fig. a) to be placed on the interior of the breast pocket of the clothing apparel 150 for magnetic attachment to the mating magnet strip 134*d* of the securing member 130*d*.

Figure 3E:
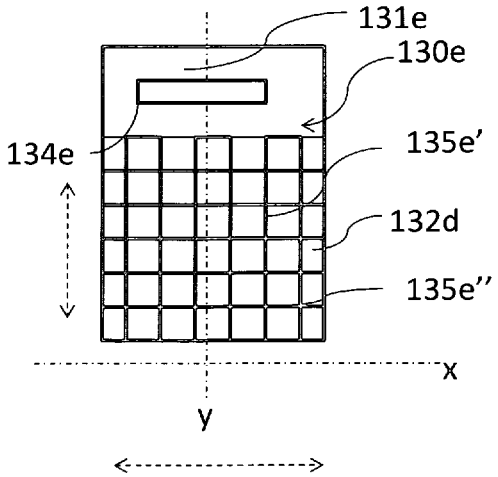

FIG. 3*e* shows an embodiment of a securing member 130*d* wherein a lower segment 132*e* is arranged as a checkerboard arrangement composed of a plurality of folds 135*e*' arranged horizontally and parallel to one another on a horizontal plane x for expansion and contraction on a vertical plane y to impart a degree of flexibility to the lower segment of the main body of the securing member. Additionally, the lower segment 132*e* is composed of a plurality of folds 135*e*" arranged vertically and parallel to one another on a vertical plane y for expansion and contraction on a horizontal plane x to impart a degree of flexibility to the lower segment of the main body of the securing member. The upper segment includes an attachment means. An optional attachment means 134*e* may be provided preferably within the upper segment 132*e*. The attachment means 134*e* is preferably a magnetic strip adapted to receive a mating magnet strip for further securing the pre-folded pocket square onto the securing member. Mating magnet strip 134*e* is adapted to mate with a magnetic insert member 154 (see Fig. a) to be placed on the interior of the breast pocket of the clothing apparel 150 for magnetic attachment to the mating magnet strip 134*e* of the securing member 130*e*. Preferably, magnetic insert member 154 is constructed having rounded corners, or no jagged edges to mitigate the risk of the insert member 154 catching on the user's shirt or interior of the jacket to prevent damage to the clothing. It is to be understood that the magnetic insert member 154 and the mating magnetic strip or portion of the securing member may be in an vast array of different sizes and shapes. Although herein shown as rectangles, the member 154 and/strip 134 may be any parallelogram, arch shape, circular or other shape to achieve the mating securement result. In each embodiment, the securing member 130 is preferably constructed wherein the upper segment is composed substantially of a rigid stiff material. Rigid stiff materials contemplated my include a rigid rubber, plastic, thick cardboard, and/or metal material.

FIGS. 4*a*-4*d* illustrates views of another embodiment of the pre-formed pocket square with securing member shown generally at 500. The pre-formed pocket square with securing member 500 is appointed to be placed within a pocket 521 of a suit jacket 520. A pre-folded pocket square member 511 is provided having a main body portion 512 and a top portion 513 having a decorative folded edge 514 as discussed hereinabove. However, in this embodiment, pre-folded pocket square member 511 is formed having a cavity 515 therein body portion 512 with an opening 516. In turn, cavity 515 of body portion 512 is adapted to receive therein through opening 516 a pre-formed pocket square securing member 530. Securing member 530 traverses through opening 516 and is relatively snuggly received within cavity 515 of pre-folded pocket square member 511 and securing member 530 imparts rigidity to pre-folded pocket square member 511. It is noted that the securing member 530 may be pre-sewn within cavity 515. In an alternative embodiment, the pre-folded pocket square member 511 with securing member 530 housed therein is removably housed within cavity 515 so that the square member 511 can be interchanged to other fold designs and/or washed, then placed within pocket 521 of jacket 520.

Preferably, a mating magnet strip 534 is integrated within the securing member 530, which may be a strip or alternatively, securing member 530 may simply include a metal segment/be composed of metal capable of mating with a magnet. In turn, the mating magnetic strip 534 (or securing member 530) is adapted to mate with a magnetic insert member 554. Magnetic insert member 554 is adapted to be placed on the interior of the breast pocket of the clothing apparel 520 for magnetic attachment to the mating magnet strip 534 of the securing member 530. Either or both of the strip and/or securing member are composed of a magnetic strip and metal/or magnetic strips for magnetic mating. In operation, the strip is adapted to be placed on an inside wall/interior of the clothing apparel in alignment with the securing member located within the pre-folded pocket square member within the pocket of the clothing apparel and the strip or magnetic insert further facilitates holding the pocket square in place in the pocket.

In this manner, pre-folded pocket square member 511 with securing member 530 housed therein and magnetic insert member 554 facilitates maintenance of a perfect upright position within pocket 521 of jacket 520 throughout wear. In the embodiment shown, securing member 530 has the shape of an elongated structure, preferably having a slightly arched or curved body 531. Accordingly, securing member 530 conforms to the shape of the user's breast as the slight arch curved body 531 rests against the wearer/user's breast or chest. As a result, a very natural look is imparted leaving the securing member undetectable to others. What is more, the elongated structure of securing member 530 slides horizontally within cavity 515, which is an elongated cavity structure so that edges 530*a*, 530*b* of the securing member 530 abut and apply slight pressure to the interior pocket walls 521*a*, 521*b* and thusly securely hold the pocket square member 511 in place. In this embodiment, the cavity of the main body of the pre-folded pocket square member is formed as an elongated narrow cavity located in only a portion of the main body of the pre-folded pocket square member and wherein the main body of the securing member is constructed as an elongated body adapted to fit within the elongated narrow cavity. Preferably, the elongated body is arched or curved.

Figure 4A:
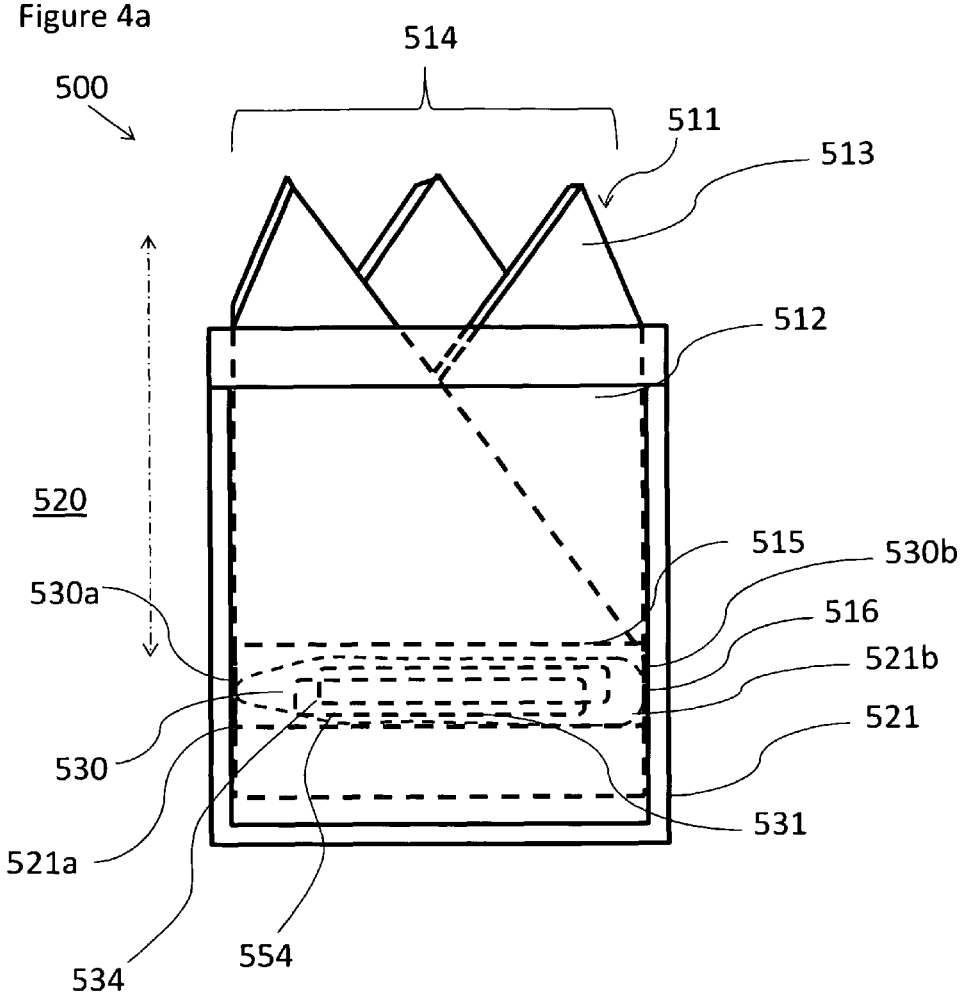
FIG. 4*a* illustrates a preferred embodiment of the subject pre-formed pocket square member with securing member, showing the pocket square and securing member within a pocket of clothing apparel.
Figure 4B:
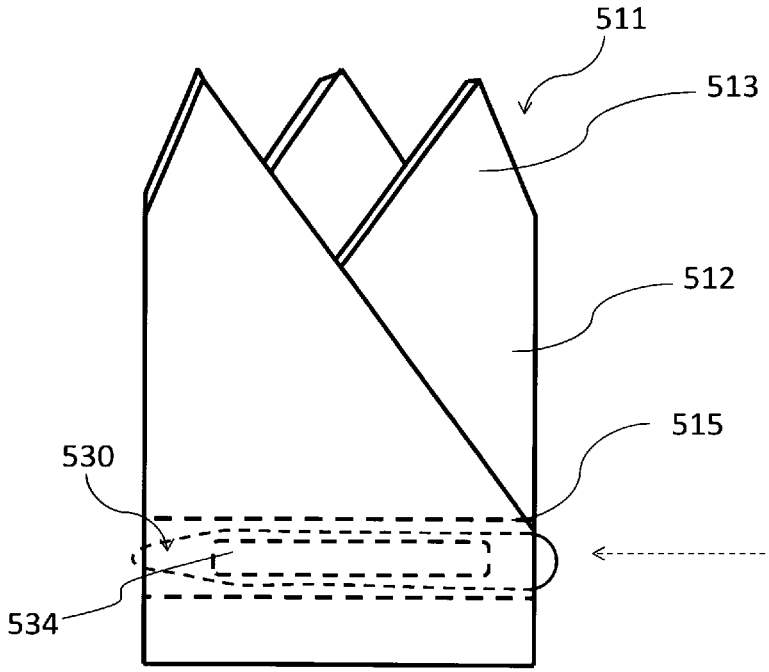
FIG. 4*b* illustrates the embodiment shown in FIG. 4*a* showing a front view of the pocket square and securing member removed from the pocket.
Figure 4C:
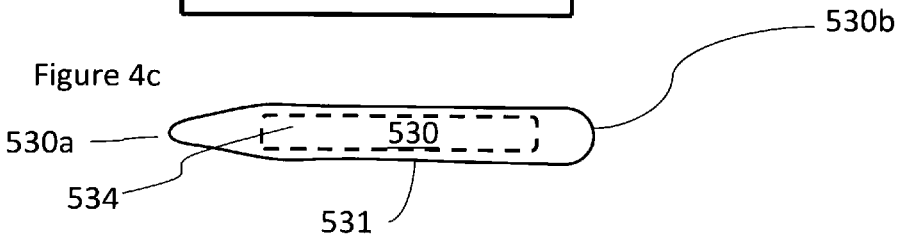
FIG. 4*c* illustrates a front view of the securing member of the embodiment shown in FIG. 4.
Figure 4D:
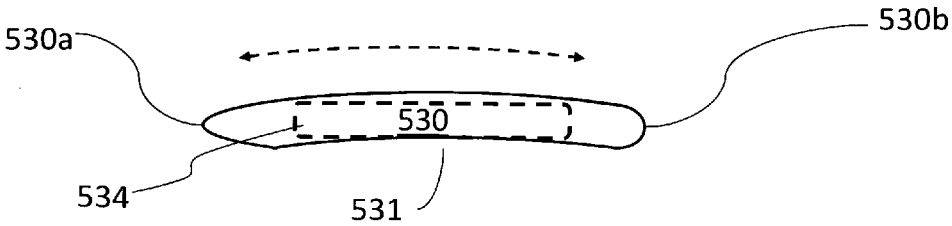
FIG. 4*d* illustrates a back view of the securing member of the embodiment shown in FIG. 4.
Figure 4E:
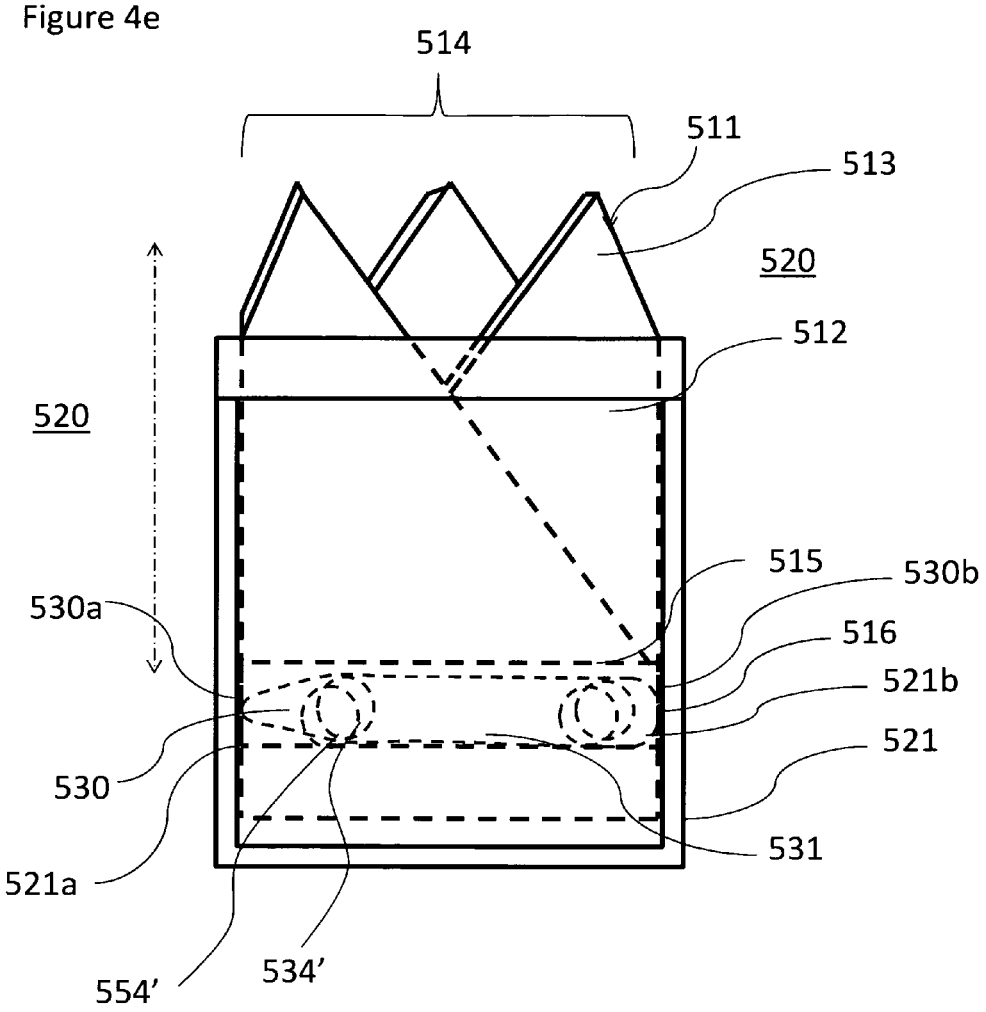
FIG. 4*e* illustrates another embodiment of the securing member shown in FIG. 4*a;*

FIG. 4*e* illustrates another embodiment of the securing member shown in FIG. 4*a*. In this embodiment the a mating magnet strip integrated within the securing member 530 is shown alternatively as two round strips 534' adapted to mate with a magnetic insert member 554'.

Figure 5A:
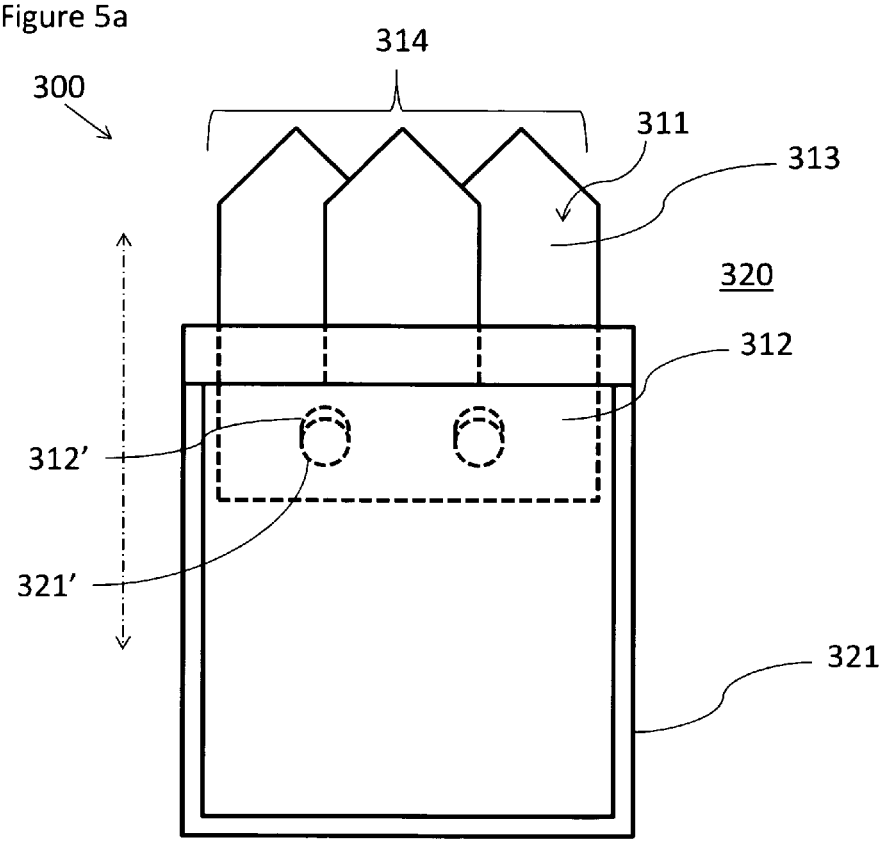
FIG. 5*a* illustrates another embodiment of the subject pre-formed pocket square member with securing member.
Figure 5B:
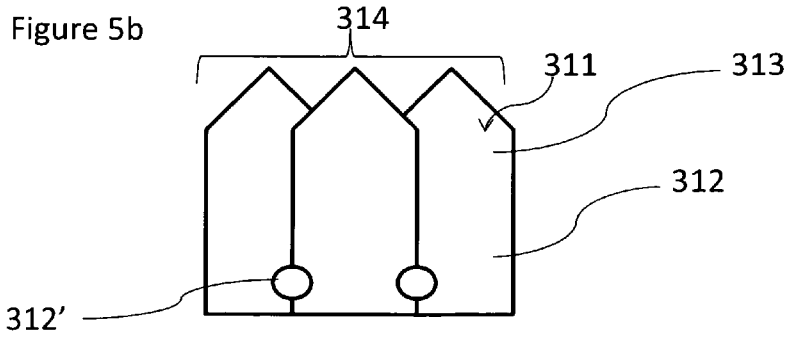
FIG. 5*b* illustrates a view of the pre-formed pocket square member of the embodiment shown in FIG. 5*a;*

FIGS. 5*a* and 5*b* illustrate another embodiment of the pre-formed pocket square with securing member shown generally at 300. The pre-formed pocket square with securing member is appointed to be placed within a pocket 321 of a suit jacket 320 lapel (or any clothing having a lapel pocket appointed to receive a pocket square therein). Herein clothing apparel is specified as a suit jacket 320; however any type of clothing apparel having a breast/lapel pocket for receiving a pocket square is contemplated for use with the invention. Pre-folded pocket square member 311 comprises a main body portion 312 and a top portion 313. Body portion 312 is appointed to be placed and received within pocket 321 while at least a portion of top portion 313 is appointed to protrude from pocket 321 and be visible for aesthetic appeal. Body portion 312 is preferably formed generally as a parallelogram, square or rectangle. Top portion 313 includes a decorative folded configuration 314. Note that a plethora of fold configurations can be utilized.

In the embodiment shown, body portion 312 of pre-folded pocket square member 311 includes attachment means integrated therein for attachment to the inside of the breast/lapel pocket 321. Herein the attachment means is shown as button holes 312'. In this embodiment, preferably pocket 321 includes internal correspondingly mating attachment means via buttons 321' that are appointed to engage with the button holes 312' of the body portion 312 of pre-folded pocket square member 311. Alternatively, rather than button holes 312', attachment means may include magnetic members, hook and loop fasteners (such as are sold commonly under the trade name Velcro), or snaps. In turn, mating internal attachment means are thusly correspondingly located within the pocket 321.

Figure 6A:
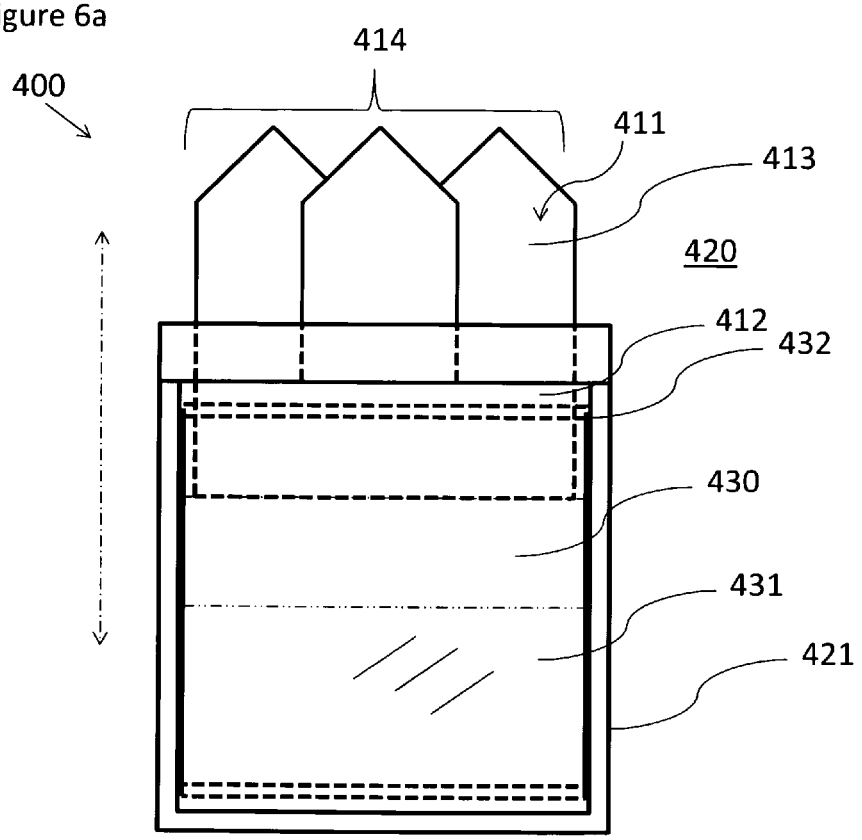
FIG. 6*a* illustrates another embodiment of the subject pre-formed pocket square member with securing member.
Figure 6B:
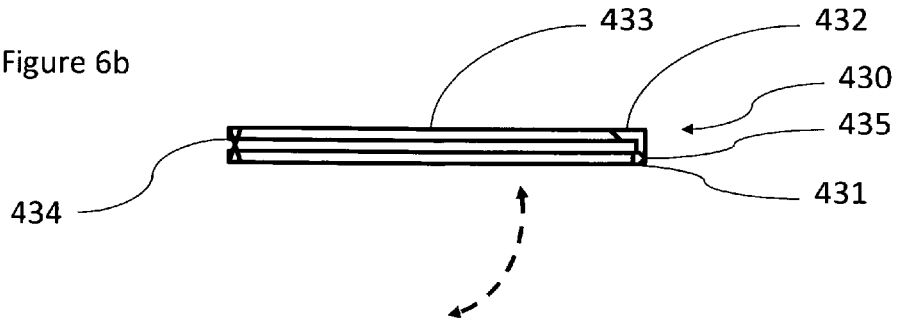
FIG. 6*b* illustrates a top view of the securing member of the embodiment shown in FIG. 6*a;*

FIGS. 6*a* and 6*b* illustrate another embodiment of the pre-formed pocket square with securing member shown generally at 400. The pre-formed pocket square with securing member is appointed to be placed within a pocket 421 of a suit jacket 420 lapel (or any clothing having a lapel pocket appointed to receive a pocket square therein). Pre-folded pocket square member 411 comprises a main body portion 412 and a top portion 413. Body portion 412 is appointed to be placed and received within pocket 421 while at least a portion of top portion 413 is appointed to protrude from pocket 421 and be visible for aesthetic appeal. Body portion 412 is preferable formed generally as a parallelogram, square or rectangle. Top portion 413 includes a decorative folded configuration 414. It will be understood that a plethora of fold configurations can be utilized.

In the embodiment shown, body portion 412 of pre-folded pocket square member 411 is appointed to be received by a pre-formed pocket square securing member 430 that includes a stiffened body 431 and attachment means 432. Attachment means 432 of securing member 430 securely removably fastens to body portion 412 to secure body portion 412 to securing member 430. Securing member 430 is then placed within pocket 421. Pre-folded pocket square member 411 with securing member 430 is housed within pocket 421 and can be interchanged to other fold designs and/or washed. In this manner, pre-folded pocket square member 411 with securing member 430 housed therein maintains a perfect upright position within pocket 421 throughout wear. In the embodiment shown, attachment means 432 of securing member 430 comprises a first portion 433 hingedly attached to body 431 so that the hinge 434 opens and closes to snap first portion 433 shut upon body 431 grasping and securing body portion 412 of square member 411. Securing member 430 may be composed of a polymeric material, silicon material, rubber, paper, metal or cardboard material. Preferably, securing member 430 is composed of a thin polymeric material, silicon, rubber, or cardboard material having some rigidity but also capable of some flexibility so as not to feel too stiff within the user's pocket. In this manner, the securing member 430 shape is retained but also provides some flexibility so that the breast pocket of the jacket/vest does not appear overly stiff and rigid. This imparts a more natural look to the exterior of the pocket and renders the use of the device imperceptible. Attachment means 432 is shown as a hinge clasp 435 on the side of the device, however, the hinge clasp can be located on the bottom of the device so as to swing upward and sandwich the body portion 431 there between. Attachment means 432 may alternatively be constructed as magnetic portions hook and loop fastener portions (such as those sold under the trade name Velcro), buttons, pins, safety pins, sowing or stitching, hooks, or clips.

Figure 7A:
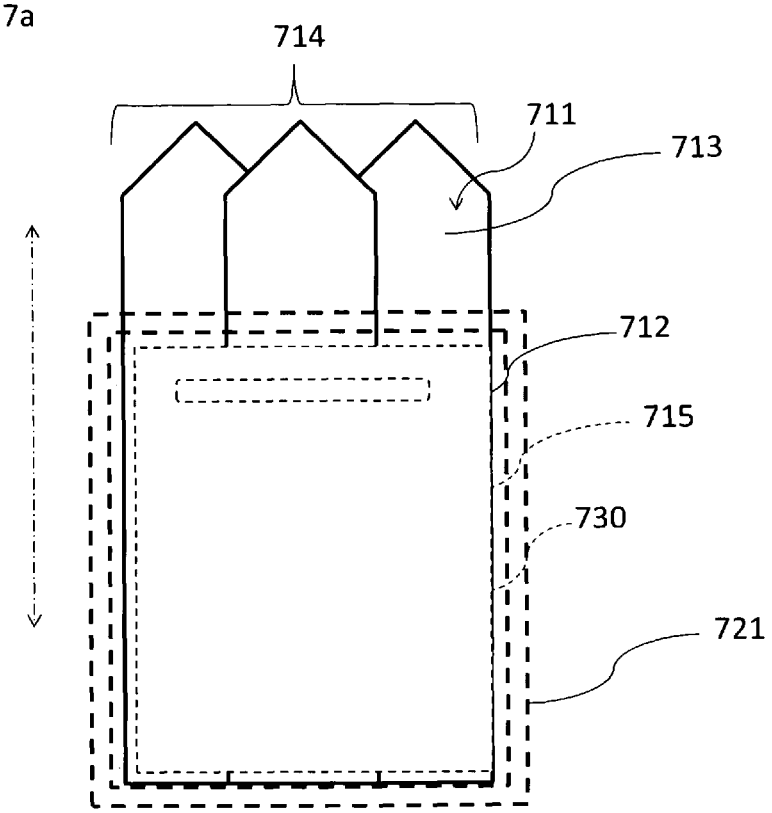
FIG. 7*a* illustrates another embodiment of the subject pre-formed pocket square member with securing member, showing the pocket square and securing member within a pocket of clothing apparel.
Figure 7B:
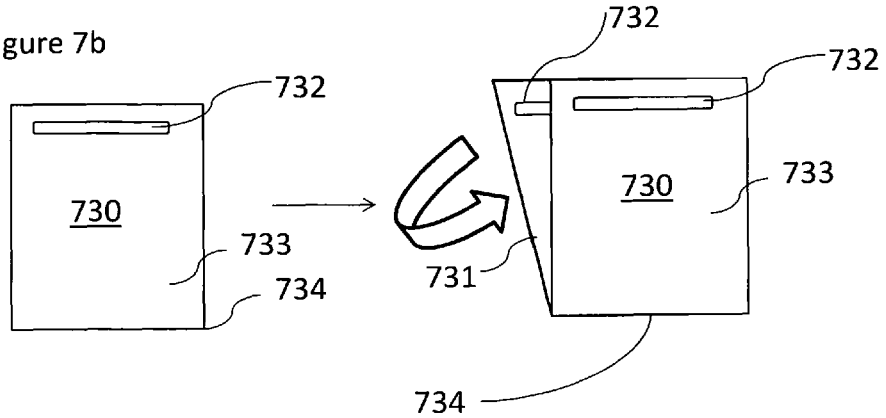
FIG. 7*b* illustrates the holder/securing member of FIG. 7*a* removed from the pocket and removed from the pre-formed pocket square.

FIGS. 7*a* and 7*b* illustrate another embodiment of the pre-formed pocket square with securing member shown generally at 700. The pre-formed pocket square with securing member is appointed to be placed within a pocket 721. Pre-folded pocket square member 711 comprises a main body portion 712 and a top portion 713. Body portion 712 is appointed to be placed and received within pocket 721 while at least a portion of top portion 713 is appointed to protrude from pocket 721 and be visible for aesthetic appeal. Body portion 712 is preferable formed generally as a parallelogram, square or rectangle. Top portion 713 includes a decorative folded configuration 714. With this embodiment, a plethora of fold configurations can be utilized.

Body portion 712 of pre-folded pocket square member 711 is appointed to be received by a pre-formed pocket square securing member 730 that includes a stiffened body 731 and attachment means 732. Preferably, attachment means 732 are mating magnetic portions. Securing member 730 may be composed of a polymeric material, silicon material, rubber, paper, metal or cardboard material. Preferably, securing member 730 is composed of a thin polymeric material, silicon, rubber, or cardboard material having some rigidity but also capable of some flexibility so as not to feel too stiff within the user's pocket. Attachment means 732 of securing member 730 securely removably fastens to body portion 712 to secure body portion 712 to securing member 730. In the embodiment shown, attachment means 732 of securing member 730 comprises a first portion 733 hingedly attached to body 731 so that the hinge 734 opens and closes to snap first portion 733 shut upon body 731 grasping and securing body portion 712 of square member 711.

Figure 8A:
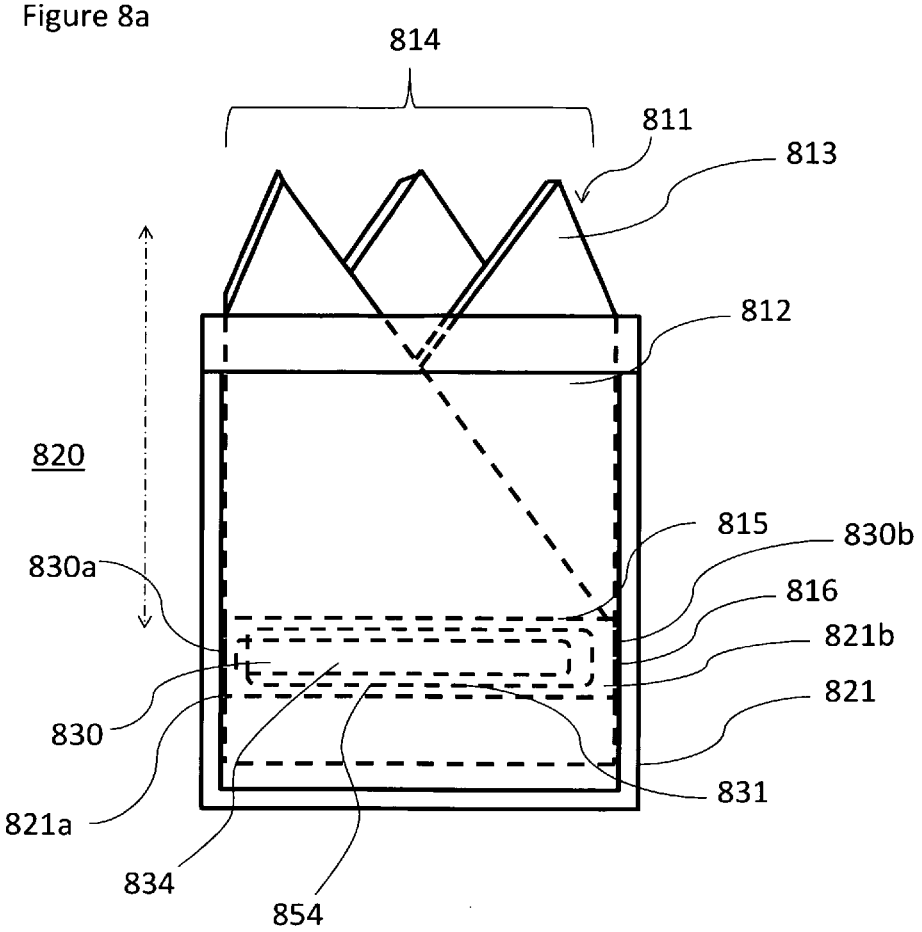
FIG. 8*a* illustrates another preferred embodiment of the subject pre-formed pocket square member with securing member, showing the pocket square and securing member within a pocket of clothing apparel.
Figure 8B:
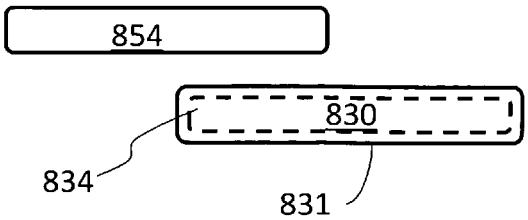
FIG. 8*b* illustrates the embodiment shown in FIG. 8*a* showing a front view of the securing member removed from the pocket square and showing the separate magnetic insert member that is adapted to be placed on the interior of the clothing apparel to mate with the securing member.

FIG. 8*a* illustrates another preferred embodiment of the subject pre-formed pocket square member with securing member, showing the pocket square and securing member within a pocket of clothing apparel. FIG. 8*b* illustrates the embodiment shown in FIG. 8*a* showing a front view of the securing member removed from the pocket square and showing the separate magnetic insert member that is adapted to be placed on the interior of the clothing apparel to mate with the securing member.

The pre-formed pocket square with securing member 800 is appointed to be placed within a pocket 821 of a suit jacket 820. A pre-folded pocket square member 811 is provided having a main body portion 812 and a top portion 813 having a decorative folded edge 814 as discussed hereinabove. However, in this embodiment, pre-folded pocket square member 811 is formed having a cavity 815 therein body portion 812 with an opening 816. In turn, cavity 815 of body portion 512 is adapted to receive therein through opening 816 a pre-formed pocket square securing member 830. Securing member 830, shown as a strip, traverses through opening 816 and is relatively snuggly received within cavity 815 of pre-folded pocket square member 811 and securing member 830 imparts rigidity to pre-folded pocket square member 811. It is noted that the securing member 830 may be pre-sewn within cavity 815. In an alternative embodiment, the pre-folded pocket square member 811 with securing member 830 housed therein is removably housed within cavity 815 so that the square member 811 can be interchanged to other fold designs and/or washed, then placed within pocket 821 of jacket 820.

Preferably, a mating magnet strip 834 is integrated within the securing member 830, which may be a strip or alternatively, securing member 830 may simply include a metal segment/be composed of metal capable of mating with a magnet. In turn, the mating magnetic strip 834 (or securing member 830) is adapted to mate with a magnetic insert member 854. Magnetic insert member 854 is adapted to be placed on the interior of the breast pocket of the clothing apparel 820 for magnetic attachment to the mating magnet strip 834 of the securing member 830. Either or both of the strip and/or securing member are composed of a magnetic strip and metal/or magnetic strips for magnetic mating. In operation, the strip is adapted to be placed on an inside wall/interior of the clothing apparel in alignment with the securing member located within the pre-folded pocket square member within the pocket of the clothing apparel and the strip or magnetic insert further facilitates holding the pocket square in place in the pocket.

In this manner, pre-folded pocket square member 811 with securing member 830 housed therein and magnetic insert member 854 facilitates maintenance of a perfect upright position within pocket 821 of jacket 820 throughout wear.

The pre-folded square member comes in an array of colors, designs, fabrics and pre-folded configurations so that a user can readily change out the style/color of the pre-folded square member and replace the newly selected pre-folded square member associated with the securing member and within the pocket of the jacket. Pre-folded square members may be sold alone or in combination with the securing member, and/or in combination with a matching tie and/or shirt or other apparel.

Having thus described the invention in rather full detail, it will be understood that such detail need not be strictly adhered to, but that additional changes and modifications may suggest themselves to one skilled in the art, all falling within the scope of the invention as defined by the subjoined claims.

What is claimed is:

1. A pre-folded pocket square member with securing member for use within a pocket of clothing apparel, comprising:

a. a pre-folded pocket square member having a main body portion with a cavity therein and an opening thereto and a top portion, wherein said body portion is appointed to be placed and received within said pocket of said clothing apparel while at least a portion of said top portion is appointed to protrude from said pocket;

b. a securing member adapted to be received within said cavity of said pre-folded pocket square member for forcing said pre-folded pocket square member to remain upright, secured and aligned within said pocket;

c. said securing member comprising a main body that conforms in size and structure to said cavity, wherein at least a portion of said main body tightly fits within said cavity of said main body portion of said pre-folded pocket square member;

wherein said securing member securely holds said pre-folded pocket square member in an upright position within said pocket.

2. A pre-folded pocket square member with securing member as recited by claim 1, wherein said main body of said securing member is formed as a wire frame having frame members and at least one open area.

3. A pre-folded pocket square member with securing member as recited by claim 1, wherein said main body of said securing member is formed as a wire frame having two parallel side wall frame members and a substantially open center area.

4. A pre-folded pocket square member with securing member as recited by claim 1, wherein said main body of said securing member is formed as a substantially solid construct without open areas, and wherein at least a portion of said solid construct is composed of a flexible material so as to impart a degree of flexibility to said securing member.

5. A pre-folded pocket square member with securing member as recited by claim 1, wherein said lower segment is composed of a plurality of folds arranged vertically and parallel to one another on a vertical plane y for expansion and contraction on a horizontal plane x to impart flexibility to said lower segment of said main body of said securing member.

6. A pre-folded pocket square member with securing member as recited by claim 1, wherein said lower segment is composed of a plurality of folds arranged horizontally and parallel to one another on a horizontal plane x for expansion and contraction on a vertical plane y to impart flexibility to said lower segment of said main body of said securing member.

7. A pre-folded pocket square member with securing member as recited by claim 1, wherein said lower segment is arranged as a checkerboard arrangement composed of a plurality of folds arranged horizontally and parallel to one another on a horizontal plane x for expansion and contraction on a vertical plane y to impart a degree of flexibility to said lower segment of said main body of said securing member, and wherein said lower segment is composed of a plurality of folds arranged vertically and parallel to one another on a vertical plane y for expansion and contraction on a horizontal plane x to impart a degree of flexibility to said lower segment of said main body of said securing member.

8. A pre-folded pocket square member with securing member as recited by claim 1, wherein said upper segment includes an attachment means.

9. A pre-folded pocket square member with securing member as recited by claim 1, wherein said upper segment is composed substantially of a rigid stiff material.

10. A pre-folded pocket square member with securing member as recited by claim 1, wherein at least a portion of said main body of said securing member is formed from a flexible material so as to impart a degree of flexibility to said securing member.

11. A pre-folded pocket square member with securing member as recited by claim 1, wherein at least a portion of said main body of said securing member is formed from a rigid material so as to impart a degree of rigidity to said securing member.

12. A pre-folded pocket square member with securing member as recited by claim 1, wherein substantially all of said main body of said securing member is inserted and received within said cavity of said pre-folded pocket square.

13. A pre-folded pocket square member with securing member as recited by claim 1, wherein more than one pre-folded pocket square is provided and said pre-folded pocket squares are provided in different fold configurations and/or colors and/or materials.

14. A pre-folded pocket square member with securing member as recited by claim 1, wherein said cavity of said main body of said pre-folded pocket square member is formed as an elongated narrow cavity located in only a portion of said main body of said pre-folded pocket square member and wherein said main body of said securing member is constructed as an elongated body/strip adapted to fit within said elongated narrow cavity.

15. A pre-folded pocket square member with securing member as recited by claim 14, wherein said elongated body is arched or curved.

16. A pre-folded pocket square member with securing member as recited by claim 14 comprising at least one strip for magnetic attachment to said elongated body, wherein either or both of said strip and/or securing member are composed of or include a magnetic strip and metal/or magnetic strips, wherein said strip is adapted to be placed on an inside wall of said clothing apparel in alignment with said elongated body located within said pre-folded pocket square member and within said pocket of said clothing apparel.

17. A pre-folded pocket square member with securing member as recited by claim 1 comprising at least one strip for magnetic attachment to said securing member, wherein either or both of said strip and/or securing member are composed of a magnetic strip and metal/or magnetic strips, wherein said strip is adapted to be placed on an inside wall of said clothing apparel in alignment with said securing member located within said pre-folded pocket square member and within said pocket of said clothing apparel.

18. A pre-folded pocket square member with securing member for use within a pocket of clothing apparel, comprising:

a. a pre-folded pocket square member, having a main body portion and a top portion wherein said body portion is appointed to be placed and received within said pocket of said clothing apparel while at least a portion of said top portion is appointed to protrude from said pocket;

b. said pre-folded pocket square member having pocket attachment means;

c. a securing member comprising mating attachment means appointed to mate with said pocket attachment means of said pre-folded pocket square member;

wherein said mating attachment means are associated with said pocket of said clothing apparel, and said mating attachment means are adapted to mate with said pocket attachment means of said pre-formed pocket square securing member to securely hold said pre-folded pocket square member within said pocket.

19. A pre-folded pocket square member with securing member as recited by claim 18, wherein said pocket attachment means of said pre-folded pocket square member and said mating attachment means of said securing member are mating hook and loop fasteners.

20. A pre-folded pocket square member with securing member as recited by claim 18, wherein said pocket attachment means of said pre-folded pocket square member and said mating attachment means of said securing member are mating magnetic portions.

21. A pre-folded pocket square member with securing member as recited by claim 18, wherein said pocket attachment means of said pre-folded pocket square member and said mating attachment means of said securing member are mating button closures.

22. A pre-folded pocket square member with securing member for use within a pocket of clothing apparel, comprising a. a pre-folded pocket square member, having a main body portion and a top portion wherein said body portion is appointed to be placed and received within said pocket of said clothing apparel while at least a portion of said top portion is appointed to protrude from said pocket;

b. a securing member that is adapted to be received within said pocket of said clothing apparel and being associated with said pre-folded pocket square member to force said pre-folded pocket square member to remain upright, secured and aligned within said pocket; and c. said securing member comprising a spring loaded holder mechanism having edges, said pocket of said clothing apparel having side walls and a bottom wall, said edges of said holder being operative to press against side walls of said pocket.

23. A pre-folded pocket square member and securing member system as recited by claim 22, wherein said edges of said spring loaded holder mechanism comprise pivoting rods attached to a spring hub so that said edges expand and contract based on pressure/force applied on said edges.

24. A pre-folded pocket square member and securing member system as recited by claim 22, wherein said edges of said spring loaded holder mechanism comprise pressure clamps for removable securement of said side walls of said pre-folded pocket square member so that said pre-folded pocket square member remains upright when said pre-folded pocket square member and said spring loaded holder mechanism are placed within said pocket.

* * * * *